US012295510B2

(12) United States Patent
Simo-Fossouo

(10) Patent No.: US 12,295,510 B2
(45) Date of Patent: May 13, 2025

(54) DRESS ZIPPER MANIPULATION ASSEMBLY

(71) Applicant: Stephane Simo-Fossouo, Wylie, TX (US)

(72) Inventor: Stephane Simo-Fossouo, Wylie, TX (US)

( * ) Notice: Subject to any disclaimer, the term of this patent is extended or adjusted under 35 U.S.C. 154(b) by 502 days.

(21) Appl. No.: 17/203,906

(22) Filed: Mar. 17, 2021

(65) Prior Publication Data

US 2022/0296020 A1 Sep. 22, 2022

(51) Int. Cl.
*A47G 25/90* (2006.01)

(52) U.S. Cl.
CPC ..... *A47G 25/902* (2013.01)

(58) Field of Classification Search
CPC ..... A47G 25/902; A47G 25/901; F16B 2/10; F16B 2/20; F16B 2/245; D06F 55/00; D06F 55/02; Y10T 24/44436; Y10T 24/4453
USPC ..... 294/3.6
See application file for complete search history.

(56) References Cited

U.S. PATENT DOCUMENTS 490,806 A * 1/1893 Gulick ..... G09F 3/14 24/511
766,870 A * 8/1904 Briney ..... D06F 55/00 24/561
2,202,352 A * 5/1940 McGugin ..... D06F 55/00 24/506
2,531,805 A * 11/1950 Clark ..... A47G 25/902 294/3.6
2,811,763 A * 11/1957 Welter ..... A47G 25/902 24/601.3
2,835,952 A * 5/1958 Mininberg ..... A47G 25/902 294/3.6
2,840,412 A * 6/1958 Lancaster ..... A47G 25/902 63/15.3
2,845,297 A * 7/1958 Doop ..... A47G 25/902 223/111
2,887,751 A * 5/1959 Lamb ..... A47G 25/902 24/698.2
2,887,752 A * 5/1959 Maio ..... A47G 25/902 294/3.6
2,888,728 A * 6/1959 Lebermann ..... A47G 25/902 294/3.6
2,900,205 A * 8/1959 Cirone ..... A47G 25/902 294/3.6
2,908,057 A * 10/1959 Blanco ..... A47G 25/902 223/111
2,928,157 A * 3/1960 Deering ..... A47G 25/902 294/3.6

(Continued)

FOREIGN PATENT DOCUMENTS

WO WO0135358 5/2001

*Primary Examiner* — F Griffin Hall

(57) ABSTRACT

A dress zipper manipulation assembly for zipping a zipper on a dress includes a clip to clamp onto a collar of a dress. A chain is coupled to the clip to extend downwardly along the dress when the clip is clipped to the collar. A clamp is coupled to the chain to engage a handle of the zipper when the clamp is in the closed position. In this way the user can pull upwardly on the chain to zip the zipper without assistance. The clamp includes a locking mechanism to releasably retain the clamp in the closed position to inhibit releasing the handle of the zipper when the chain is pulled upwardly.

9 Claims, 3 Drawing Sheets

(56) References Cited

U.S. PATENT DOCUMENTS 2,939,193 A * 6/1960 Myles ..... A47G 25/902 294/3.6
2,974,991 A * 3/1961 Gerrick ..... A47G 25/902 294/3.6
2,994,300 A * 8/1961 Grahling ..... A01K 27/005 119/770
3,059,301 A * 10/1962 Dierks ..... A47G 25/902 294/3.6
3,122,809 A * 3/1964 Shee ..... A47G 25/902 294/3.6
3,201,839 A * 8/1965 Reifsteck ..... A47G 25/902 294/3.6
3,249,977 A * 5/1966 Cloud, Sr. ..... A47G 25/902 294/3.6
3,276,087 A * 10/1966 Hanson ..... A47G 25/902 294/3.6
3,355,779 A * 12/1967 Hurst ..... A47G 25/902 294/3.6
3,568,901 A * 3/1971 McNitt ..... A47G 25/902 223/111
3,704,491 A * 12/1972 Burgess ..... A47G 25/902 294/3.6
3,836,189 A * 9/1974 Borrelli ..... A47G 25/902 294/99.2
3,951,319 A * 4/1976 Huntress ..... A47G 25/902 294/3.6
4,022,506 A * 5/1977 Cloud, Sr. ..... A47G 25/902 294/3.6
5,855,401 A * 1/1999 Papernik ..... A47G 25/902 24/40
D405,028 S * 2/1999 Papernik ..... D11/221
5,971,262 A 10/1999 Moore
5,975,386 A * 11/1999 Fernicola ..... A47G 25/902 223/111
6,032,996 A * 3/2000 Kogen ..... A47G 25/902 24/40
6,112,958 A * 9/2000 LaMacchia ..... A47G 25/92 223/111
6,842,951 B1 * 1/2005 Barre ..... B25B 7/02 24/515
6,967,575 B1 11/2005 Dohrmann
8,358,199 B2 1/2013 Nesling
D714,514 S 9/2014 Petit
8,910,983 B1 * 12/2014 Neff ..... A47G 25/902 24/429
9,289,084 B1 * 3/2016 McKeown ..... A44B 19/262
9,301,632 B2 * 4/2016 Harris ..... A44B 19/262
9,750,363 B2 * 9/2017 Burton ..... A47G 25/902
9,775,456 B2 * 10/2017 Catania ..... A47G 25/902
D821,261 S * 6/2018 Alvarez ..... D11/221
9,999,311 B1 * 6/2018 Penso ..... A47G 25/902
10,945,547 B2 * 3/2021 Denton ..... A47G 25/902
11,457,758 B2 * 10/2022 Thomas ..... A44B 19/262
2001/0045449 A1 11/2001 Shannon
2002/0040564 A1 4/2002 Killingbeck
2004/0263029 A1 12/2004 Scholefield
2009/0201198 A1 8/2009 Moudy
2012/0169076 A1 * 7/2012 Brake ..... A47G 25/902 294/3.6
2013/0341940 A1 * 12/2013 Taurman ..... A47G 25/902 294/3.6
2016/0304235 A1 10/2016 Herkenrath
2017/0251856 A1 9/2017 Schaible

* cited by examiner

DRESS ZIPPER MANIPULATION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to zipper manipulation devices and more particularly pertains to a new zipper manipulation device for zipping a zipper on a dress.

(2) Description of Related Art Including Information Disclosed Under 37 CFR 1.97 and 1.98

The prior art relates to zipper manipulation devices. The prior art discloses a tube that has a pair of end caps and a chain extending between the end caps. One of the end caps is attached to zipper on a dress and the other end cap is drawn upwardly to zip the zipper. The prior art discloses a telescopic rod that is attachable to a zipper for drawing the zipper upwardly. The prior art discloses an elongated handle that includes a gripper for gripping a zipper to draw the zipper upwardly. The prior art discloses a two part coupler, one of which being coupled to a zipper and the other of which is gripped for drawing the zipper upwardly.

BRIEF SUMMARY OF THE INVENTION

An embodiment of the disclosure meets the needs presented above by generally comprising a clip to clamp onto a collar of a dress. A chain is coupled to the clip to extend downwardly along the dress when the clip is clipped to the collar. A clamp is coupled to the chain to engage a handle of the zipper when the clamp is in the closed position. In this way the user can pull upwardly on the chain to zip the zipper without assistance. The clamp includes a locking mechanism to releasably retain the clamp in the closed position to inhibit releasing the handle of the zipper when the chain is pulled upwardly. Additionally, the prior art discloses a clasp for engaging a zipper on a heavy duty storage bag thereby enhancing gripping the zipper for opening and closing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
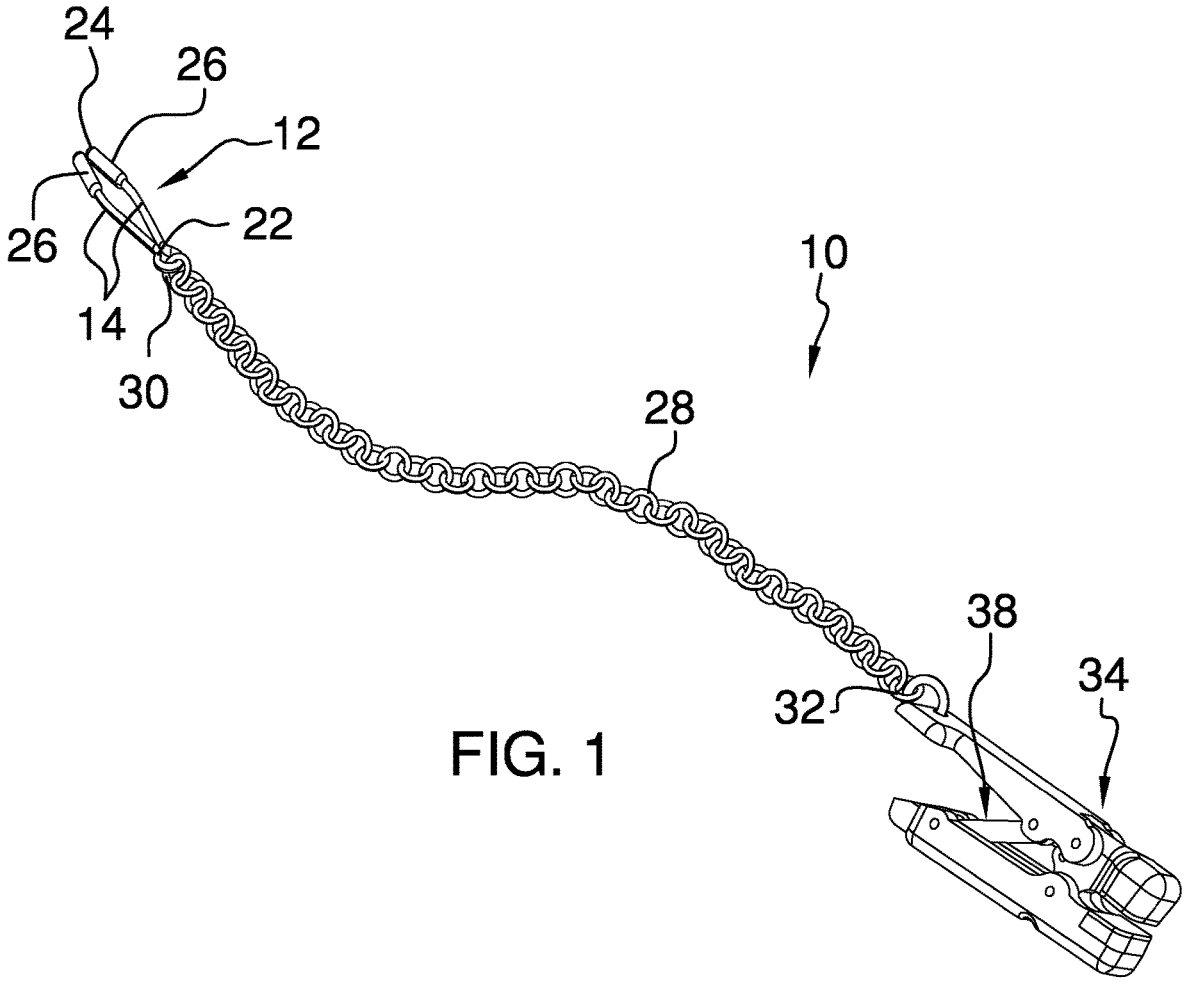
FIG. 1 is a perspective view of a dress zipper manipulation assembly according to an embodiment of the disclosure.
Figure 2:
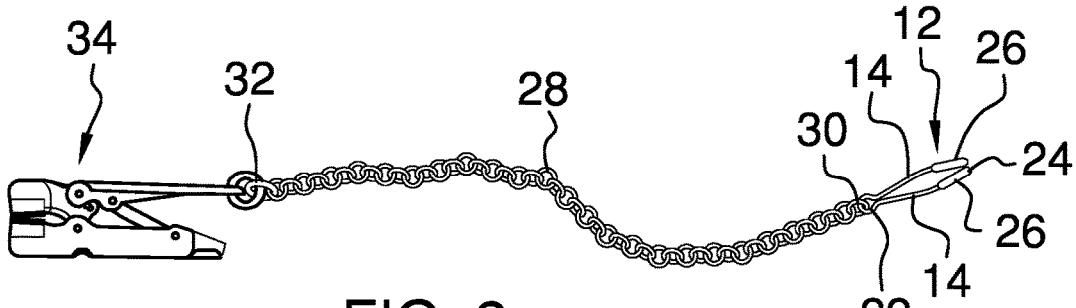
FIG. 2 is a left side view of an embodiment of the disclosure.
Figure 3:
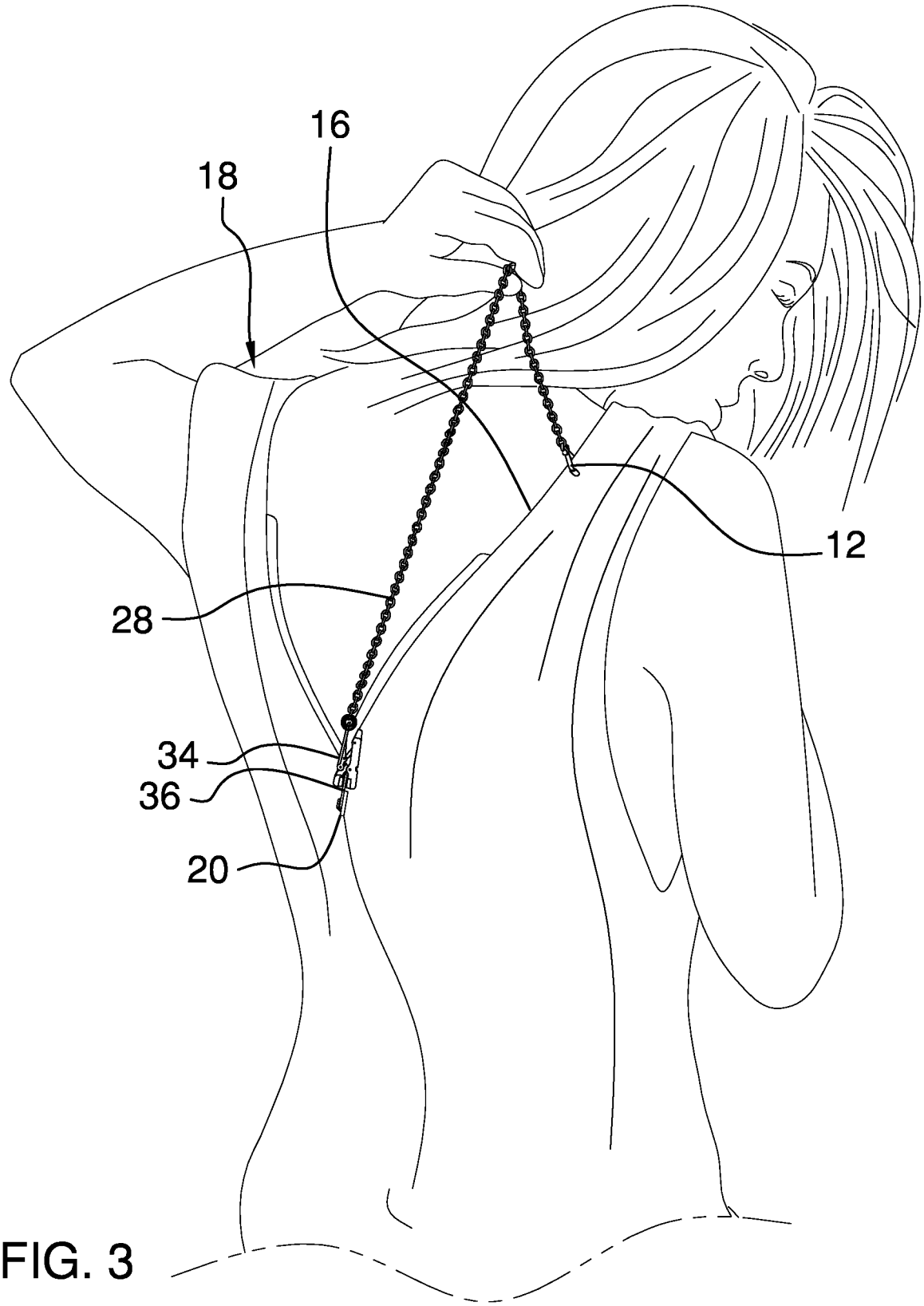
FIG. 3 is a perspective in-use view of an embodiment of the disclosure.
Figure 4:
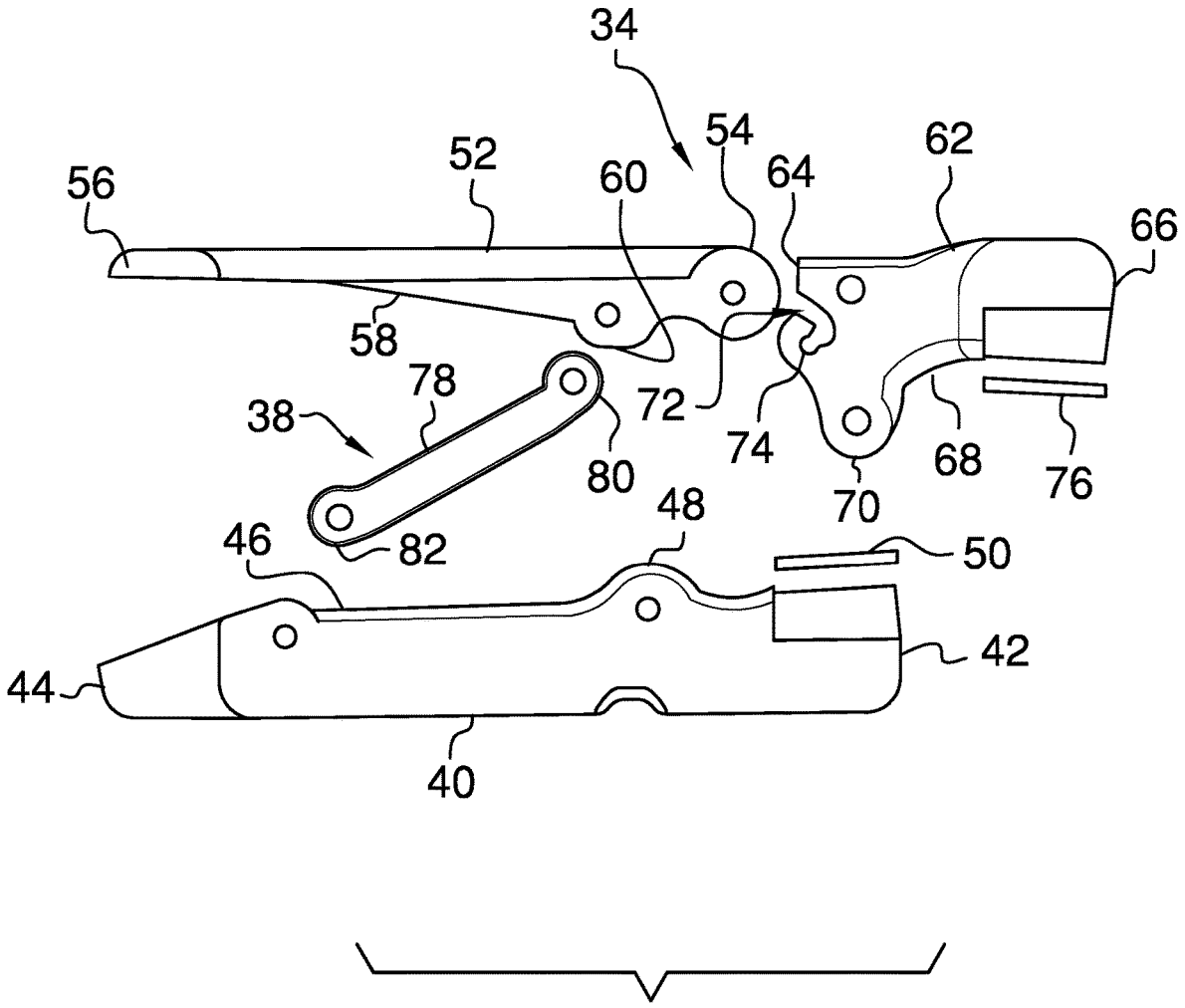
FIG. 4 is an exploded view of a clamp of an embodiment of the disclosure.

With reference now to the drawings, and in particular to FIGS. 1 through 6 thereof, a new zipper manipulation device embodying the principles and concepts of an embodiment of the disclosure and generally designated by the reference numeral 10 will be described.

As best illustrated in FIGS. 1 through 6, the dress zipper manipulation assembly 10 generally comprises a clip 12 that has a pair of members 14 being biased against each other. In this way the clip 12 can clamp onto a collar 16 of a dress 18 or other garment that has a zipper 20 on the back side of the garment. Each of the members 14 has a coupled end 22 and a free end 24. The coupled end 22 of each of the members 14 is coupled together having the members 14 being oriented coextensive with each other. Additionally, each of the members 14 is concavely arcuate with respect to each other thereby biasing the free end 24 of the members 14 toward each other.

A pair of grips 26 is each coupled around a respective one of the members 14 of the clip 12 and each of the grips 26 extends from the free end 24 toward the coupled end 22. Each of the grips 26 is comprised of a resiliently compressible material, such as rubber, silicone or other similar material to frictionally engage the collar 16 of the dress 18. A chain 28 is coupled to the clip 12 to extend downwardly along the dress 18 when the clip 12 is clipped to the collar 16. The chain 28 has a first end 30 and a second end 32, and the first end 30 is attached to the coupled end 22 of each of the members 14 of the clip 12. A cable, a string or any other similar elongate object may be used in lieu of the chain 28.

A clamp 34 is coupled to the chain 28 and the clamp 34 is positioned adjacent to a zipper 20 on the dress 18 when the clip 12 is clipped to the collar 16. The clamp 34 is positionable in an open position or a closed position. The clamp 34 engages a handle 36 of the zipper 20 when the clamp 34 is in the closed position to facilitate the user to pull upwardly on the chain 28 to zip the zipper 20 without assistance. The clamp 34 includes a locking mechanism 38 to releasably retain the clamp 34 in the closed position to inhibit releasing the handle 36 of the zipper 20 when the chain 28 is pulled upwardly. In this way the person wearing the dress 18 can zip up the zipper 20 without assistance. Additionally, the clamp 34, the chain 28 and the clip 12 may each be comprised of stainless steel, silver or other precious metal to enhance the ornamental appearance of the dress 18.

The clamp 34 comprises a first member 40 has a first end 42, a second end 44 and a top side 46 extending therebetween, and the top side 46 has a pivot point 48 thereon. The pivot point 48 is positioned closer to the first end 42 of the first member 40 than the second end 44 of the first member 40 and the top side 46 has an engagement point 50 located adjacent to the first end 42. The clamp 34 includes a second member 52 that has a primary end 54, a secondary end 56 and a bottom side 58 extending therebetween. The bottom side 58 has a pivot point 60 thereon that is positioned closer to the primary end 54 than the secondary end 56. Additionally, the second end 32 of the chain 28 is coupled to the secondary end 56 of the second member 52.

The clamp 34 includes a third member 62 that has a rear end 64, a front end 66 and a lower side 68, and the lower side 68 has a pivot point 70 thereon positioned adjacent to the rear end 64. Moreover, the pivot point 70 on the third member 62 rotatably engages the pivot point 48 on the first member 40. The third member 62 has a slot 72 extending from the rear end 64 toward the pivot point 70 on the third member 62. The slot 72 has a terminal end 74 and the slot 72 is curved between the rear end 64 and the terminal end 74.

The primary end 54 of the second member 52 rotatably engages the slot 72. The second member 52 is positionable in a closed position having each of the second member 52 and the third member 62 oriented collinear with each other. Conversely, the second member 52 is positionable in an open position having the second member 52 forming an angle with the third member 62. The lower side 68 of the third member 62 has an engagement point 76 located adjacent to the front end 66.

The locking mechanism 38 is defined by a support 78 that has an upper end 80 and a lower end 82, and the upper end 80 is pivotally coupled to the pivot point 60 on the second member 52. The lower end 82 is pivotally coupled to the pivot point 48 on the first member 40. The engagement point 50 on the first member 40 compresses against the engagement point 76 on the third member 62 when the second member 52 is positioned in the closed position. In this way the first member 40 and the third member 62 compress the handle 36 on the zipper 20. Additionally, the support 78 is positioned at a pre-determined angle such that the support 78 inhibits the second member 52 being moved out of the closed position without being manipulated by a user. The engagement point 50 on the first member 40 is spaced from the engagement point 76 on the third member 62 when the second member 52 is positioned in the open position. In this way the third member 62 and the first member 40 can release the handle 36 of the zipper 20.

In use, the clip 12 is attached to the collar 16 of the dress 18 and the clamp 34 is attached to the handle 36 of the zipper 20. In this way the user can grasp the chain 28 and draw the chain 28 upwardly to zip up the zipper 20 without assistance. The clamp 34 and the clip 12 can each be removed from the dress 18 at any time for laundering or the like. Additionally, the precious metal construction of the clip 12, chain 28 and clamp 34 enhances the ornamental appearance of the dress 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dress zipper manipulation assembly being configured to assist a person wearing a dress to zip the dress up, said assembly comprising:

a clip having a pair of members being biased against each other wherein said clip is configured to clamp onto a collar of a dress;

a chain being coupled to said clip wherein said chain is configured to extend downwardly along the dress when the clip is clipped to the collar;

a clamp being coupled to said chain wherein said clamp is configured to be positioned adjacent to a zipper on the dress when said clip is clipped to the collar, said clamp being positionable in an open position or a closed position, said clamp engaging a handle of the zipper when said clamp is in said closed position wherein said clamp is configured to facilitate the user to pull upwardly on said chain to zip the zipper without assistance, said clamp including a locking mechanism to releasably retain said clamp in said closed position wherein said clamp is configured to inhibit releasing the handle of the zipper when said chain is pulled upwardly;

wherein said clamp comprises a first member having a first end, a second end and a top side extending therebetween, said top side having a pivot point thereon, said pivot point being positioned closer to said first end of said first member than said second end of said first member, said top side having an engagement point being located adjacent to said first end wherein said clamp comprises a second member having a primary end, a secondary end and a bottom side extending therebetween, said bottom side having a pivot point thereon being positioned closer to said primary end than said secondary end; and wherein said clamp comprises a third member having a rear end, a front end and a lower side, said lower side having a pivot point thereon being positioned adjacent to said rear end, said pivot point on said third member rotatably engaging said pivot point on said first member, wherein third member has a slot extending from said rear side toward said pivot point on said third member, said slot having a terminal end, said slot being curved between said rear side and said terminal end, said primary end of said second member rotatably engaging said slot.

2. The assembly according to claim 1, wherein each of said members has a coupled end and a free end, said coupled end of each of said members being coupled together having said members being oriented coextensive with each other, each of said members being concavely arcuate with respect to each other thereby biasing said free end of said members toward each other.

3. The assembly according to claim 2, further comprising a pair of grips, each of said grips being coupled around a respective one of said members of said clip, each of said grips extending from said free end toward said coupled end, each of said grips being comprised of a resiliently compressible material wherein each of said grips is configured to frictionally engage the collar of the dress.

4. The assembly according to claim 2, wherein said chain has a first end and a second end, said first end being attached to said coupled end of each of said members of said clip.

5. The assembly according to claim 1, wherein said second member is positionable in a closed position having each of said second member and said third member being oriented collinear with each other, said second member being positionable in an open position having said second member forming an angle with said third member, said lower side of said third member having an engagement point being located adjacent to said front end.

6. A dress zipper manipulation assembly being configured to assist a person wearing a dress to zip the dress up, said assembly comprising:

a clip having a pair of members being biased against each other wherein said clip is configured to clamp onto a collar of a dress;

a chain being coupled to said clip wherein said chain is configured to extend downwardly along the dress when the clip is clipped to the collar;

a clamp being coupled to said chain wherein said clamp is configured to be positioned adjacent to a zipper on the dress when said clip is clipped to the collar, said clamp being positionable in an open position or a closed position, said clamp engaging a handle of the zipper when said clamp is in said closed position wherein said clamp is configured to facilitate the user to pull upwardly on said chain to zip the zipper without assistance, said clamp including a locking mechanism to releasably retain said clamp in said closed position wherein said clamp is configured to inhibit releasing the handle of the zipper when said chain is pulled upwardly;

wherein said clamp comprises a first member having a first end, a second end and a top side extending therebetween, said top side having a pivot point thereon, said pivot point being positioned closer to said first end of said first member than said second end of said first member, said top side having an engagement point being located adjacent to said first end wherein said clamp comprises a second member having a primary end, a secondary end and a bottom side extending therebetween, said bottom side having a pivot point thereon being positioned closer to said primary end than said secondary end;

wherein said clamp comprises a third member having a rear end, a front end and a lower side, said lower side having a pivot point thereon being positioned adjacent to said rear end, said pivot point on said third member rotatably engaging said pivot point on said first member;

wherein said second member is positionable in a closed position having each of said second member and said third member being oriented collinear with each other, said second member being positionable in an open position having said second member forming an angle with said third member, said lower side of said third member having an engagement point being located adjacent to said front end; and wherein said locking mechanism comprises a support having an upper end and a lower end, said upper end being pivotally coupled to said pivot point on said second member, said lower end being pivotally coupled to said pivot point on said first member.

7. The assembly according to claim 6, wherein said engagement point on said first member compresses against said engagement point on said third member when said second member is positioned in said closed position wherein said first member and said third member are configured to compress the handle on the zipper.

8. The assembly according to claim 6, wherein said engagement point on said first member being spaced from said engagement point on said third member when said second member is positioned in said an open position wherein said third member and said first member are configured to release the handle of the zipper.

9. A dress zipper manipulation assembly being configured to assist a person wearing a dress to zip the dress up, said assembly comprising:

a clip having a pair of members being biased against each other wherein said clip is configured to clamp onto a collar of a dress, each of said members having a coupled end and a free end, said coupled end of each of said members being coupled together having said members being oriented coextensive with each other, each of said members being concavely arcuate with respect to each other thereby biasing said free end of said members toward each other;

a pair of grips, each of said grips being coupled around a respective one of said members of said clip, each of said grips extending from said free end toward said coupled end, each of said grips being comprised of a resiliently compressible material wherein each of said grips is configured to frictionally engage the collar of the dress;

a chain being coupled to said clip wherein said chain is configured to extend downwardly along the dress when the clip is clipped to the collar, said chain having a first end and a second end, said first end being attached to said coupled end of each of said members of said clip; and a clamp being coupled to said chain wherein said clamp is configured to be positioned adjacent to a zipper on the dress when said clip is clipped to the collar, said clamp being positionable in an open position or a closed position, said clamp engaging a handle of the zipper when said clamp is in said closed position wherein said clamp is configured to facilitate the user to pull upwardly on said chain to zip the zipper without assistance, said clamp including a locking mechanism to releasably retain said clamp in said closed position wherein said clamp is configured to inhibit releasing the handle of the zipper when said chain is pulled upwardly, said clamp comprising:

a first member having a first end, a second end and a top side extending therebetween, said top side having a pivot point thereon, said pivot point being positioned closer to said first end of said first member than said second end of said first member, said top side having an engagement point being located adjacent to said first end;

a second member having a primary end, a secondary end and a bottom side extending therebetween, said bottom side having a pivot point thereon being positioned closer to said primary end than said secondary end, said second end of said chain being coupled to said secondary end of said second member;

a third member having a rear end, a front end and a lower side, said lower side having a pivot point thereon being positioned adjacent to said rear end, said third member having a slot extending from said rear side toward said pivot point on said third member, said pivot point on said third member rotatably engaging said pivot point on said first member, said slot having a terminal end, said slot being curved between said rear side and said terminal end, said primary end of said second member rotatably engaging said slot, said second member being positionable in a closed position having each of said second member and said third member being oriented collinear with each other, said second member being positionable in an open position having said second member forming an angle with said third member, said lower side of said third member having an engagement point being located adjacent to said front end; and wherein said locking mechanism is defined by a support having an upper end and a lower end, said upper end being pivotally coupled to said pivot point on said second member, said lower end being pivotally coupled to said pivot point on said first member, said engagement point on said first member compressing against said engagement point on said third member when said second member is positioned in said closed position wherein said first member and said third member are configured to compress the handle on the zipper, said engagement point on said first member being spaced from said engagement point on said third member when said second member is positioned in said an open position wherein said third member and said first member are configured to release the handle of the zipper.

* * * * *